United States Patent [19]

Aigo

[11] Patent Number: 4,500,080

[45] Date of Patent: Feb. 19, 1985

[54] CARRIER FOR CLEANING AND ETCHING WAFERS

[76] Inventor: Seiichiro Aigo, 3-15-13, Negishi, Daito-ku, Tokyo, Japan

[21] Appl. No.: 407,732

[22] Filed: Aug. 13, 1982

[30] Foreign Application Priority Data

Mar. 15, 1982 [JP] Japan ..... 57-36024[U]

[51] Int. Cl.[3] ..... B23Q 1/04

[52] U.S. Cl. ..... 269/56; 235/380

[58] Field of Search ..... 235/380; 364/468, 478; 198/350, 349, 341; 414/134, 136; 269/55, 56, 903, 290

[56] References Cited

U.S. PATENT DOCUMENTS

| | | | |
|---|---|---|---|
| 1,506,926 | 9/1924 | Gunter | 206/260 |
| 3,868,057 | 2/1975 | Chavez | 235/380 |
| 3,934,122 | 1/1976 | Riccitelli | 235/380 |
| 4,204,113 | 5/1980 | Giraud et al. | 235/380 |

FOREIGN PATENT DOCUMENTS

| | | | |
|---|---|---|---|
| 48004 | 4/1980 | Japan | 414/136 |

*Primary Examiner*—Robert C. Watson

*Attorney, Agent, or Firm*—McGlew and Tuttle

[57] ABSTRACT

A carrier supports a single lot of prescribed sheets of semiconductor wafers so as to transfer the semiconductor wafers from one processing step to another processing step in their cleaning and etching processing. The carrier, or a container for the carrier, includes an information member holder and an information member detachably supported by the holder. An information member includes a semiconductor chip which constitutes a microprocessor and memory. The above carrier can bring about numerous merits which include:

(1) Each processing or treatment apparatus is operated in accordance with instructions given by the information member and instruction errors can be effectively avoided;

(2) The completion of each processing or treatment step and other information pertaining the step are all stored in the memory, thereby facilitating correct collation; and (3) The information member may be formed into an information card, which is small in size and extremely convenient for handling.

5 Claims, 3 Drawing Figures

CARRIER FOR CLEANING AND ETCHING WAFERS

BACKGROUND OF THE INVENTION (a) Field of the Invention

This invention relates to an improvement in or relating to a carrier for supporting a single lot of prescribed sheets of semiconductor wafers from one processing of treatment step to another in their cleaning and etching processing or treatment. More particularly, it relates to such a wafer-supporting carrier as mentioned above, which is provided with an information member, for example, an information card containing a semiconductor chip which in turn constitutes a microprocessor and memory.

(b) Description of the Prior Art

The cleaning and etching processing or treatment (hereinafter referred simply to "cleaning and etching processing") generally consists of 100–200 processing steps. Semiconductor wafers are supported on a carrier as a single lot of 25–50 sheets and successively transferred from one processing step to another so as to subject them to prescribed processing or treatment. The control of each processing step has heretofore been carried out in accordance with the mannual control system, which is dependent on process control cards, or the computerized control system which makes use of punched cards. In the former system, process information are added to process control cards by hand-writing. The latter system uses key punching machines as terminal equipment. Irrespective of the systems, the prior art system are accompanied by a drawback that no satisfactory collation is available due to lack of correctness. Furthermore, it is rather difficult to automate the overall processing or treatment with such prior art systems. Even if the processing or treatment should be automated, all instructions cannot help depending on human operators so that instruction errors are thus unavoidable. In addition, the prior art systems are accompanied by the production of rubbish since process control cards are made of paper. This has been a serious problem particularly for wafers because wafers are to be used for the fabrication of super precision parts. They are also accompanied by another problem that such control cards or punched cards do not permit the writing-in of problems which their respective wafer encounter during processing or treatment or any other things which operators notice upon carrying out the processing or treatment.

SUMMARY OF THE INVENTION

This invention seaks to solve the above problems of the prior art systems. Accordingly, an object of this invention is to make it possible to conduct, in a correct and automated fashion each step of a wafer cleaning and etching process or treatment.

To achieve the above object of this invention, the characteristic feature of a carrier for supporting a single lot of prescribed sheets of semiconductor wafers according to this invention resides in that the carrier is combined with an information member which contains a semiconductor chip constituting a microcomputer or a microprocessor and memory.

Accordingly, in one aspect of this invention, there is provided a carrier for supporting a single lot of prescribed sheets of semiconductor wafers so as to transfer the single lot of prescribed sheets of semiconductor wafers from one processing step to another processing step in their cleaning and etching processing. The carrier or its container includes an information member holder and an information member detachably supported by the holder. The information member includes a semiconductor chip which constitutes a microprocessor and memory.

According to this invention, a wafer carrier is provided with an information member, whereby enabling to perform the automation and control of each cleaning or etching step of wafers. Therefore, the carrier according to this invention can bring about numerous merits, including:

(a) Each processing or treatment apparatus is instructed by the information member and no instruction error will thus arise;

(b) The completion of each processing or treatment step and other information pertaining the step are all stored in the memory, thereby facilitating correct collation;

(c) The operator is only required at each processing or treatment step to take out and slip in the information member which may be in the form of an information card or the like, and the handling of the informaton member is extremely easy owing to its compactness;

(d) The problem of rubbish can be completely solved because the main body of the information member may be made of a synthetic resin;

(e) The information member permits free writing-in of problems and the like which may occur in each step; and (f) Key punching machines or terminal equipment for punched cards, are not required any longer.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENTS

Figure 1:
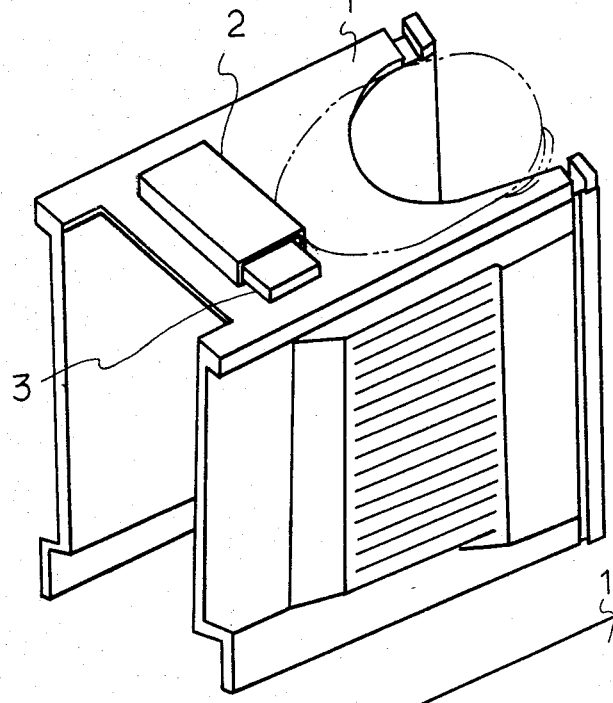
FIG. 1 is a perspective view of a carrier for cleaning and etching wafers, according to one embodiment of this invention.

As shown in FIG. 1, a carrier 1 for supporting semiconductor wafers S is provided with a pocket 2 at a suitable location thereof. In the pocket 2, there is inserted an information member, for example, an information card 3 as shown in the figure. Carriers of the above type are in many instances made of a resin. Thus, the pocket 2 is made of the same material as the carrier 1 as an integral part. The pocket 2 has such dimensions that it leaves some margins when the card 3 is inserted therein, whereby facilitating the insertion or removal of the information card 2. In the embodiment illustrated in FIG. 1, the portion supporting the information card 3 is shaped in the form of a pocket. It is not absolutely required to form such a portion into pocket. It is sufficient that the information card 3 can be retained on the carrier 1. Thus, the configurations of the holding portion 2 shall not be limited to any specific ones.

Figure 2:
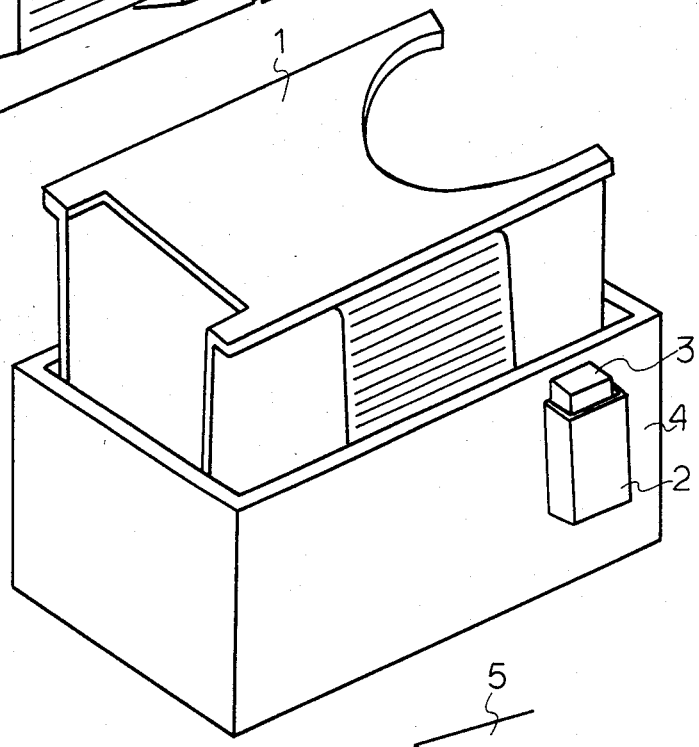
FIG. 2 is a perspective view of a carrier for cleaning and etching wafers, according to another embodiment of this invention.

Furthermore, it is also sufficient that the information card 3 is capable of accompanying the carrier 1. Thus, it is not absolutely necessary to form the holding portion 2 of the information card 1 on the carrier 1. As illustrated in FIG. 2, the holding portion 2 may be provided in the form of a pocket or the like on a suitable location of a container 4 adapted to enclose the carrier 1 therein. The carrier 1 and its container 4 are available in varied shapes. Needless to say, the location of the holding portion 2 may be selected suitably in accordance with the shape of each carrier or container. In addition, the information member may not be required to be in a plate-like shape such as the information card. It may take a block-line form as seen in FIG. 2 or may be in any other suitable shape.

Figure 3:
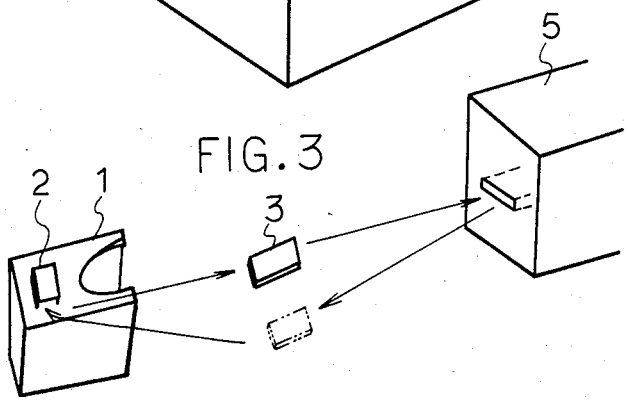
FIG. 3 is a schematic illustration showing the handling of an information member provided with the carrier in a step of the wafer cleaning and etching processing or treatment.

As has been described above, the wafer carrier according to this invention is provided with the information member 3, which contains a semiconductor chip serving as a microprocessor and memory. Accordingly, it is possible to store in the microprocessor all the processing and treatment steps of the wafer cleaning and etching processing or treatment as programmed information prior to using the information member 3. Then, as illustrated in FIG. 3, the information member 3 is taken out of the holding portion 2 of the carrier 1 at each processing or treatment station and inserted into a signal input/output and control unit 5, thereby delivering prescribed signals from the unit 5 to a processing or treatment apparatus to carry out the prescribed processing or treatment. Upon completion of the processing or treatment step, the information member 3 is ejected from the signal input/output unit 5 and then manually returned into the holding portion 2 of the carrier 1. Thereafter, the carrier 1 is transferred to the next processing or treatment station and prescribed processing or treatment is carried out there in the same procedure. When the prescribed processing or treatment has been completed at each station, a signal is delivered from the processing or treatment apparatus to the input/output unit 5. The signal may then be stored in the memory of the information member 3. If any problems arise or any other things are noticed during the processing or treatment, they may also be stored as records in the memory. Such records may be collected after the completion of the overall processing or treatment and may be effectively used as reference when similar wafers are to be produced later on.

As has been described above, the present invention has solved various problems or inconveniences of the prior art techniques in the process control of cleaning and etching of semiconductor wafers. It can therefore promote substantial rationalization and efficiency improvement with respect to the cleaning and etching work of semiconductor wafers.

Having now fully described the invention, it will be apparent to one or ordinary skill in the art that many changes and modifications can be made thereto without departing from the spirit or scope of the invention as set forth herein.

What is claimed is:

1. In a carrier for supporting a single lot of prescribed sheets of semiconductor wafers so as to transfer the single lot of prescribed sheets of semiconductor wafers from one processing step to another processing step in their cleaning and etching processing, in combination with equipment for effecting the steps, the improvement comprises said carrier having an information member holder and an information member detachably supported by said holder, and the informatin member includes a semiconductor chip which constitutes a microprocessor and reading and writing memory, said holder being formed on said carrier as an integral part thereof and being shaped in the form of a pocket for said information member, and an input/output control unit connected to said equipment for effecting the steps, which unit receives said information member for controlling said equipment and storing information about the steps.

2. The carrier set forth in claim 1, wherein the body of said information member and said carrier and holder are made of a synthetic resin.

3. The carrier set forth in claim 1, wherein said information member is an information card.

4. The carrier set forth in claim 1, wherein said information member is of a plate-like form.

5. The carrier set forth in claim 1, wherein said information member is of a block-like form.

* * * * *